US005677268A

United States Patent [19]

Omosako et al.

[11] Patent Number: 5,677,268

[45] Date of Patent: Oct. 14, 1997

[54] LUBRICANT FOR USE IN HOT ROLLING OF HIGH CHROMIUM STAINLESS STEEL

[75] Inventors: Kouji Omosako; Toshiro Yamada; Akifumi Hiramatsu, all of Kure, Japan

[73] Assignee: Nisshin Steel Co., Ltd., Tokyo, Japan

[21] Appl. No.: 716,456

[22] PCT Filed: Mar. 25, 1995

[86] PCT No.: PCT/JP95/00550

§ 371 Date: Dec. 6, 1996

§ 102(e) Date: Dec. 6, 1996

[87] PCT Pub. No.: WO95/26390

PCT Pub. Date: Oct. 5, 1995

[30] Foreign Application Priority Data

Mar. 25, 1994 [JP] Japan ..... 6-079534

[51] Int. Cl.[6] ..... C10M 173/00

[52] U.S. Cl. ..... 508/171; 427/424

[58] Field of Search ..... 508/171; 427/424

[56] References Cited

U.S. PATENT DOCUMENTS 5,468,402 11/1995 Hachiya et al. ..... 508/171

FOREIGN PATENT DOCUMENTS

| | | |
|---|---|---|
| 52-142704 | 11/1977 | Japan . |
| 54-35985 | 11/1979 | Japan . |
| 60-184405 | 9/1985 | Japan . |
| 63-254185 | 10/1988 | Japan . |
| 64-83309 | 3/1989 | Japan . |
| 6-136380 | 5/1994 | Japan . |

*Primary Examiner*—Jacqueline V. Howard

*Attorney, Agent, or Firm*—Lowe, Price, LeBlanc & Becker

[57] ABSTRACT

A lubricant for use in hot rolling of high chromium stainless steel, the lubricant being continuously supplied to surfaces of hot rolling rolls in contact with the steel being rolled at least during hot rolling of the stainless steel, which lubricant comprises a viscous aqueous solution of water soluble high molecular weight thickener and from 10 to 40% by weight of iron hydroxide powder dispersed in the aqueous solution, said iron hydroxide powder having a median particle size of from not less than 0.1 μm to less than 1 μm and said lubricant having an apparent viscosity within the range of from 1,000 to 50,000 cP.

5 Claims, No Drawings

LUBRICANT FOR USE IN HOT ROLLING OF HIGH CHROMIUM STAINLESS STEEL

FIELD OF THE INVENTION

The invention relates to a lubricant for use in hot rolling of stainless steel, especially stainless steel having a high chromium content, to prevent roll scoring.

BACKGROUND OF THE INVENTION

Since stainless steel strip and steel sheet (as used herein "steel sheet" refers to both steel sheet and steel strip) need to have a beautiful surface, during the production of stainless steel the formation of surface defects should be prevented as far as possible. However, when stainless steel is hot rolled by means of a tandem mill, defects may be caused in the surface of the steel sheet by part of the stainless steel being rolled being picked up by rolls and transferred to the material.

Roll scoring is considered to arise from contact between the surfaces of the hot rolling rolls and the hot rolled material (metal to metal touch). In particular, the higher the chromium content of the surface, the more difficult it is for scale to form on the surface. Also, since when scale does form it forms at a very slow rate, in the hot rolling of high chromium stainless steel there is increased opportunity for metal to metal contact to occur, and therefore a tendency toward a higher incidence of roll scoring. Such roll scoring degrades the shape of roll surfaces, and this degradation is transferred to the surface of the rolled material, degrading the shape of the rolled material. The surface defects of the cold rolled product, even if they are of a slight extent, not only limit application of the product, for example, make the product unsuitable for use in mirror finished applications, but also require to be remedied by polishing for use in other applications. Extensive surface defects can mean a financial loss, since the product can only be used as scrap.

Various approaches have been made in efforts to resolve such problems. These approaches include reduction of the rolling load, selection of rolling conditions, selection of roll material, and selection of lubricants.

Various animal and vegetable fats and oils, and various mineral and synthetic lubricants, have been proposed as lubricants to be applied to rolls to prevent roll scoring. Methods have also been studied comprising spraying rolls with rolling lubricating oil in which are dispersed particles having a lubricating function. However, these methods do not completely prevent roll scoring, especially in hot rolling of high chromium stainless steel. JP-A-64-83309 describes an aqueous lubricant for use in hot rolling of stainless steel to prevent roll scoring, which comprises a viscous aqueous solution having dispersed therein from 1 to 30% by weight of iron oxide powder. As described therein, the invention of this disclosure is based on the idea that if slow formation of surface oxide scale is what causes roll scoring during hot rolling of stainless steel, the problem can be resolved by actively supplying iron oxide powder from the exterior to supplement the scale that is lacking. The disclosure mentioned $Fe_2O_3$ and $Fe_3O_4$ as iron oxide powders that could be used in a particle size not exceeding 10 μm dispersed in an aqueous solution thickened to an appropriate viscosity by a water soluble high molecular weight compound. As examples of the water soluble high molecular weight compound that could be used to thicken the solution, the disclosure mentioned polyacrylic acid and carboxyvinyl polymer.

JP-A-63-254195 discloses a lubricating oil composition for use in suppressing roll scoring during hot rolling of stainless steel comprising a suspension of iron oxide powder in lubricating oil, or a composition comprising a lubricating oil to which are added iron oxide powder and a polymer substance that is not water-soluble but does dissolve in the oil.

While the above disclosures are directed at supplying iron oxide from an external source to between the rolls and the material being rolled, there have been other approaches in which the object is to oxidize the roll surface. In one example of such an approach, JP-B-54-35985 describes a method comprising supplying iron hydroxide to the rolls during rolling using water as the supply medium, to thereby form a roll surface coating having ferrosoferric oxide as the principle component. According to this disclosure, a black synthetic coating was formed on the roll, either when Adamite (a readily-oxidized cast alloy used for making rolls) rolls were used that during the hot rolling process were sprayed from a coolant nozzle with cooling water containing a 5% solution of ferric hydroxide or when a 10% to 20% suspension of ferric hydroxide was directly applied to rolls by a felt wiper arrangement. However, these methods are described with reference to the hot rolling of ordinary steel, and do not include a description relating to the hot rolling of stainless steel.

JP-A-60-184405, in contrast to that approach, discloses a method of using iron hydroxide to oxidize the surface of the material being rolled. In the roughing and finish hot rolling of stainless steel, by supplying the iron hydroxide to the material between roughing passes or between the final roughing pass and the first finish rolling pass, oxide scale is formed on metal surface portions exposed by the removal of scale during the preceding rolling pass, thereby ensuring that the metal surface portions are not exposed when the material is subjected to the next rolling pass. The iron hydroxide is supplied to the surface of the rolled material either in the form of a colloid sprayed in a carrier gas, or the iron hydroxide is prepared as a suspension in water or in rolling lubricant oil that is sprayed onto the material. According to the description of the disclosure, thus passing the steel through the hot rolling rolls after oxide scale is reformed on the material suppresses roll scoring and gives the rolled material a beautiful surface.

JP-A-52-142704 discloses a hot rolling lubricant comprising a rolling oil based polymer emulsion and a substance with lubricating properties. This lubricant raises the friction coefficient and improves the contact properties. However, it is intended for use with ordinary steels having a low chromium content, and as such is considered inadequate for use with high chromium steels such as stainless steel.

OBJECT OF THE INVENTION

We carried out further tests and studies using as a starting point the idea described with respect to the invention of JP-A-64-83309. With respect to the described lubricant, it was found that while it was possible to obtain a viscous aqueous solution in which the iron oxide powder was uniformly dispersed directly after the powder was mixed into the solution, precipitation of the iron oxide powder occurred in the container, so dispersion could not be stably maintained over an extended period of time. Unless the iron oxide powder suspension is stably maintained, under actual working conditions the iron oxide powder cannot be stably supplied to the rolling rolls. What happens is that the powder settles and collects in joints of the lubricant supply piping, clogging up the pipes and preventing sufficient lubricant from reaching the rolls. This meant that there was a risk that the object of preventing roll scoring might not be fully achieved. In recent years there has been a move toward making automobile exhaust system components of high chromium stainless steel, which offers good resistance to high-temperature oxidation. However, a high chromium content means a thinner layer of surface scale formed on the hot rolled steel during the hot rolling process, which means, in turn, that roll scoring is more likely to occur. While the above-described lubricant using iron oxide powder is effective for preventing roll scoring in the case of relatively low chromium stainless steel, it cannot be categorically stated that it can fully prevent roll scoring in the case of high chromium stainless steel. Thus, one object of this invention is to solve that problem.

Furthermore, while the invention of JP-B-54-35985 can be used to form a coating of $Fe_3O_4$ on a roll made of Adamite, which has a surface that is readily oxidized and is used widely in hot rolling of ordinary steel, it cannot be used thus to form a stable coating on rolls used for hot rolling of stainless steel such as high chromium rolls or rolls formed of high speed steel. Even if a coating of $Fe_3O_4$ were to be formed on a roll, it is inconceivable that a thin coating could effectively prevent roll scoring in the case of rolls operated at high speed over extended periods for hot rolling of stainless steel. This can also be said of the disclosure of JP-A-60-184405 which is directed at forming an iron oxide layer on the rolled material before the material enters the rolls. This is because it is particularly difficult to form an iron oxide coating on high chromium stainless steel, and even if a coating is formed, it is a thin one. Therefore, an object of this invention is to overcome the limitation of known methods in which rolling is carried out after forming a surface coating of iron oxide on the rolls or on the material being rolled, by providing a lubricant that solves the problem of roll scoring even in the hot rolling of high chromium stainless steel. More specifically, an object is to provide a lubricant having properties that allow the lubricant to be stably supplied over the entire roll surface and having an excellent roll scoring prevention effect even with respect to high chromium stainless steel.

The term high chromium stainless steel as used herein refers to stainless steel having a chromium content of not less than 20% as defined by the formula hereinbelow.

DISCLOSURE OF THE INVENTION

In accordance with this invention, a lubricant is provided for use in hot rolling of high chromium stainless steel, the lubricant being continuously supplied to surfaces of hot rolling rolls in contact with the steel being rolled at least during the hot rolling of the stainless steel, which lubricant comprises a viscous aqueous solution of water soluble high molecular weight thickener and from 10 to 40% by weight of iron hydroxide powder dispersed in the aqueous solution, said iron hydroxide powder having a median particle size of from not less than 0.1 μm to less than 1 μm, said lubricant having an apparent viscosity within the range of from 1,000 to 50,000 cP (centipoise).

The iron hydroxide is preferably iron hydroxide represented by the general formula FeO(OH). The thickener is preferably a water soluble bridged compound type polyacrylic acid or water soluble biogum such as xanthan gum. If required, an appropriate amount of an ester based nonionic surfactant such as ethylene glycol fatty acid ester or propylene fatty acid ester may be added to the lubricant of the invention.

The hot rolling lubricant according to the invention can prevent roll adhesion during hot rolling of high chromium stainless steel having a chromium content equivalent to not less than 20% as defined by the following equation (1).

$$\text{Cr equivalent } (\%)=[Cr]+2[Si]+2.5[Al]+1.2[Mo]-30[C]-15[N]-2[Ni]-[Mn] \quad (1)$$

Here, component elements in square brackets represent the content in weight percent of the component element in the steel.

DETAILED DESCRIPTION OF THE INVENTION

A cause of roll scoring during hot rolling of stainless steel is the slow rate of surface scale formation owing to the high oxidation resistance property of stainless steel. Thus, when the steel is subjected to multiple rolling passes and raw base metal of the steel is exposed in one rolling pass, the scale formation that takes place before the next rolling pass is not sufficient to protect the base surface. This phenomenon is particularly pronounced in the case of high chromium materials having good high-temperature oxidation resistance. Even if surface scale does form on high chromium stainless steel, the scale has a high concentration of $Cr_2O_3$ or $Al_2O_3$, and is thin and easily fractured. That being the case, portions of the base metal of the materials being rolled are readily exposed and contact and adhere to the metal of the rolling rolls, giving rise to roll scoring.

We found that even in the case of high chromium stainless steel, such roll scoring could be prevented by supplying the surface metal of the rolling rolls with a viscous aqueous solution containing a dispersion of iron hydroxide powder. More specifically, with the lubricant according to the invention, formed by dispersing an appropriate amount of fine iron oxide powder having a median particle size of from not less than 0.1 μm to less than 1 μm in a viscous aqueous solution in which a suitable thickener has been dissolved, roll scoring is prevented, even in hot rolling of high chromium stainless steel, by supplying the lubricant to a roll surface or a roll bite so that during the hot rolling the lubricant is between the rolling rolls and the material to be rolled. Just how this prevents roll scoring is not entirely clear. However, interactions among the following phenomena are thought to play a part: the fact that when a roll coated with the lubricant of the invention comes into contact with the material being rolled that is at a high temperature, the iron hydroxide powder, for example FeO(OH), in the lubricant produces the instantaneous decomposition reaction $$2FeO(OH) \rightarrow Fe_2O_3+H_2O;$$

the fact that the $Fe_2O_3$ thus produced covers portions of the material surface exposed during the rolling process, thereby preventing direct contact between the exposed metal portions and roll metal; the fact that the lubricating action of the lubricant itself lowers the friction coefficient between the material being rolled and the rolls; and the fact that the above decomposition reaction is an endothermic reaction that serves to lower the roll surface temperature, reducing metal to metal adhesion.

The individual components comprising the lubricant of the invention will now be described.

Iron hydroxide powders

The lubricant of the invention contains from 10 to 40% by weight of iron hydroxide powder having a median particle size substantially of from not less than 0.1 μm to less than 1 μm. Forms of the iron hydroxide powder include FeO (OH), $Fe(OH)_2$ and $Fe(OH)_3$. Any of these powders can be utilized for the lubricant. However, in view of the fact that FeO(OH) powder can be obtained commercially with the most stability while it is difficult to commercially obtain $Fe(OH)_2$ and $Fe(OH)_3$ in powder form, FeO(OH) is the most practical choice.

The lubricant of the invention should contain from 10 to 40% by weight of iron hydroxide powder, and may also contain an appropriate amount iron oxide or the like. Forms of iron oxide and FeO, $Fe_2O_3$ and $Fe_3O_4$. However, since commercially it is difficult to obtain FeO on a stable basis, it is preferable to use $Fe_2O_3$ and/or $Fe_3O_4$ powder.

However, when the material is high chromium stainless steel with a chromium content of 20% or more, it is preferable to use a lubricant that contains only iron hydroxide powder, with no admixture of iron oxide. This is because unlike iron oxide, through the above-mentioned decomposition reaction iron hydroxide powder has the effect of preventing roll scoring even when the material being rolled is high chromium stainless steel. An iron hydroxide content of substantially 10 to 40% by weight is appropriate. The iron hydroxide used need not necessarily be of high purity, but may be contaminated by an amount of impurities, such as $SiO_2$, MnO, metals and oxides that is within a normal range, such as up to 5% by weight.

Particle size of iron hydroxide powder

The particle size of the iron hydroxide powder has a major bearing on the uniform dispersibility of the powder in the viscous aqueous solution, on the dispersion state, on the stability of the dispersion over time, and, when the lubricant is supplied to the surface of the hot rolling rolls, on the distribution uniformity and on the entrainability between the material being rolled and the rolls. As such, selection of a suitable particle size is of key importance. If iron hydroxide powder having a median particle size of between 1 μm and 10 μm is mixed into a viscous aqueous solution having a slightly high viscosity, at the time of the mixing a uniform distribution may be obtained. However, precipitation of the iron hydroxide powder will take place if the solution is kept for an extended period of time. Also, a high viscosity makes it difficult to supply the solution to the rolls. It was found that using particles of less than 1 μm reduces such problems, and selecting a suitable thickener to adjust the viscosity, enabled a good dispersion state to be held over a long period. Also, for the same iron hydroxide content, a better roll surface covering efficiency is obtained with finer particles. Furthermore, the finer the particles, the more uniform the iron oxide coating produced by the decomposition reaction. For these reasons, it is preferred to use iron hydroxide powder having a median particle size of less than 1 μm.

On the other hand, aggregation readily occurs if the median particle size is too small, for example less than 0.1 μm, making it difficult to obtain a uniform dispersion of the iron hydroxide powder in the viscous aqueous solution. In addition, such small particles are difficult to manufacture commercially, and are therefore more costly. For these reasons, the lubricant of the invention uses iron hydroxide powder having a median particle size of from not less than 0.1 μm to less than 1 μm. While it depends on the manufacturing process, with iron hydroxide powder particles usually being smaller than iron oxide powder particles, iron hydroxide powder having a median particle size of from not less than 0.1 μm to less than 1 μm can be readily obtained. With iron hydroxide powder that fine, the particles can easily enter fissures in surface scale, and a larger amount are entrained between the material being rolled and the rolling rolls, effectively preventing metal to metal contact.

Iron hydroxide powder content amount

The content of the iron hydroxide powder in the lubricant has to be limited to an amount that provides the desired roll scoring prevention effect and enables the lubricant to be stably supplied to the roll surface. It was found that in the case of the stainless steel of equation (1) having a chromium content of not less than 20%, the roll scoring prevention effect could be obtained with an iron hydroxide powder content of not less than 5% by weight. However, since in practice roll scoring may still arise owing to fluctuations in rolling conditions and the like, it is necessary to use an iron hydroxide powder content of not less than 10% by weight. The higher the chromium content of the stainless steel, the higher the iron hydroxide powder content should be. However, it was found that if the lubricant contains more than 40% by weight of iron hydroxide powder, the holding ability of the dispersion tended to deteriorate with time, and the high powder content tended to increase the apparent viscosity of the lubricant, as a result of which an impractically high level of energy is required to spray the lubricant from the delivery nozzles onto the rolling rolls. For these reasons, it is necessary to limit the iron hydroxide powder content of the lubricant to from 5 to 40% by weight, preferably from 10 to 40%, and more preferably to from 10 to 30%.

Viscous aqueous solution

While water can be used as the medium for supplying iron hydroxide powder to the roll surface, it was found that in practice mere water is not suitable because in addition to the water exhibiting poor adhesion to the surfaces of rolling rolls, there was considerable precipitation of the powder in the delivery pipes through which the water is pumped. If a fat or oil or lubricating oil is used as the iron hydroxide powder supply medium, it can be difficult to obtain an even dispersion if the iron hydroxide powder does not exhibit lipophilic properties. These problems can be substantially resolved by using a supply medium comprising a viscous aqueous solution prepared by dissolving a suitable water soluble thickener in an appropriate amount of water.

Thickeners

Many water soluble thickening agents are known. Examples of water soluble high molecular weight compound which can be used as a thickener include cellulose ethers and polyacrylic acids. We tried dispersing iron hydroxide powder in viscous aqueous solutions using these thickeners. As a result, we found that adequate maintenance of a dispersion of the iron hydroxide powder was not always possible with a viscous aqueous solution containing a cellulose ether such as methyl cellulose or carboxymethyl cellulose. This was also true of straight chain bridged compound type water soluble polyacrylic acid based high polymers.

However, it was found that good dispersion could be maintained when the water soluble substance used was a bridged compound type polyacrylic acid. Bridged compound type polyacrylic acids include those formed by applying a bridging reaction to polyacrylic acid, and a copolymer formed from an acrylic acid monomer and a bridging agent. The fact that, unlike in a straight chain high molecular weight compound, in each of these, high polymers linked by bridges into a three-dimensional arrangement are soluble in water is considered to contribute to the holding ability of the iron hydroxide powder dispersion. In the case of polysodium acrylate, in which the causative factor is thought to be the large numbers of radicals dissociated when the substance is dissolved in water, it was established that the substance has the effect of maintaining the iron hydroxide powder in a good dispersion.

It was also found that dispersion holding ability was further improved when water soluble biogum was used to thicken the viscous aqueous solution, particularly xanthan gum produced by fermentation of carbohydrates with *Xanthomonas campestri*. In particular, while dilution of with water while the lubricant is being pumped through supply delivery pipes promotes aggregation of the powder, but it was found that this is suppressed when xanthan gum is used as the thickener, thereby also preventing clogging of spray nozzles.

The bridged compound type polyacrylic acid, polysodium acrylate or xanthan gum or other such biogum used as a thickener for the lubricant of the invention can all be obtained on the market.

Amount of thickener

It is necessary to adjust the amount of the thickener added to the viscous aqueous solution in which the iron hydroxide powder has been dispersed, so that the resultant lubricant has an apparent viscosity within the range 1,000 to 50,000 cP. This viscosity value refers to the value obtained by measuring the viscosity of the lubricant with a B viscometer, at a shear rate of 1.2/s and a temperature of 20° C. An amount of thickener in the range 0.1 to 3% by weight may be added to obtain the above viscosity; the actual amount will depend on the amount of iron hydroxide and on the type of thickener used.

Surfactant

The roll scoring prevention effect of the lubricant can be strengthened by adding an appropriate amount of a suitable surfactant. The addition of the surfactant improves the dispersion state of the iron hydroxide powder, and the lubricant leakage property is also improved, increasing the amount of lubricant that adheres to the rolls when the rolls are sprayed with the lubricant. The result is increased entrainment of the iron hydroxide powder into the roll bite that provides a strong roll scoring prevention effect. Nonionic ester surfactants are particularly suitable, such as ethylene glycol fatty acid ester and propylene fatty acid ester. Adding more than 5% by weight of surfactant will reduce lubricant viscosity and lower the iron hydroxide holding ability, so the added amount of surfactant is set at not exceeding 5% by weight.

Lubricant viscosity

In order to obtain stable dispersion preservation of the iron hydroxide powder, it is necessary to adjust the particle size and content of the powder and the type and amount of thickener, as described above. If the viscosity of the lubricant is lower than 1,000 cP, the adhesion of the powder to the rolls will be poor, and good dispersion, and preservation of the dispersion, of the powder in the viscous aqueous solution will not be achieved. The low viscosity will also give rise to deposits and buildup in the reservoir tank and the feed piping between the reservoir tank and the nozzles. On the other hand, a high apparent viscosity of over 50,000 cP will make it difficult to evenly disperse the iron hydroxide powder in the lubricant, and also makes it difficult to spray the lubricant from the nozzles. For these reasons, lubricant viscosity is limited to 1,000 to 50,000 cP, and more preferably to 4,000 to 20,000 cP. A viscosity within that range will increase the amount of iron hydroxide powder in the roll bite, effectively preventing direct metal to metal contact between the material being rolled and the roll. The lubricant according to the invention is preferably neutral or weakly alkaline to ensure it does not corrode the rolling equipment.

Applying the lubricant

The lubricant of the invention can be applied as follows during hot rolling of the stainless steel. First the lubricant is prepared and is put into the reservoir with the iron hydroxide powder in the dispersed state. The lubricant is pumped through pipes to nozzles arranged near the rolling rolls. The pumping normally has to be done at a minimum pressure of around 10 kgf/cm$^2$, for which a plunger type pump is suitable.

During hot rolling of the stainless steel, lubricant from the nozzle is continuously sprayed onto the rotating rolls. There is no particular limitation on the type of rolling stands on which the lubricant can be used. The stands may be selected from among the finishing rolling stands and rough rolling stands of a hot strip mill. It is usually preferable to spray the lubricant uniformly over the whole width of a roll in contact with the material being rolled. However, edge deformation during roughing passes can give rise to pronounced separation of the oxide scale layer, and when that happens, the lubricant may be selectively sprayed onto the edge portions of the material being rolled.

While the lubricant spray rate is adjusted according to the velocity of the hot rolling, a suitable spray rate would be from around 0.1 liter/m$^2$ to several liters/m$^2$ of each roll surface area in contact with the material being rolled. The lubricant is directed toward preventing high chromium stainless steel sticking to the rolls, also contributes to lowering the friction coefficient. At the same time the lubricant can also be used together with normal lubricants and the like for conventional objects such as reducing the rolling load during hot rolling of stainless steel.

Examples of the lubricant of the invention are described below. As shown be the examples, using the lubricant provides a new method of hot rolling high chromium stainless steel that prevents roll scoring, resulting in high chromium rolled steel with good surface properties. Specifically, a method of hot rolling high chromium stainless steel is provided characterized by a lubricant provided for use in hot rolling of high chromium stainless steel being continuously sprayed on a surface of a hot rolling roll in contact with the steel being rolled at least during the hot rolling of the stainless steel from a nozzle disposed in the vicinity of the roll facing toward the roll surface, which lubricant comprises a viscous aqueous solution of water soluble high molecular weight thickener and from 10 to 40% by weight of iron hydroxide powder dispersed in the aqueous solution, said iron hydroxide powder having a median particle size of from not less than 0.1 μm in to less than 1 μm, said lubricant having an apparent viscosity within the range of from 1,000 to 50,000 cP (centipoise). Hot rolling as used herein refers to hot rolling of high chromium stainless steel under normal hot rolling conditions by, for example, rough rolling and finish rolling mills. A major effect is provided by the use of the lubricant constituted as described, especially when the lubricant is applied to the hot rolling of the stainless steel of equation (1) having a chromium content of not less than 20% by weight.

EXAMPLES

Example 1

Lubricants Nos. 1 to 19 listed in Table 1 were prepared. One or two powders selected from FeO(OH), $Fe_2O_3$ and $Fe_3O_4$ were dispersed in the lubricants in the listed weight percentages. Also listed are the median particle sizes (in μm) of the powders, and the powder compositions, by weight. Table 1 also indicates the thickener used in each lubricant, whether or not a surfactant was used, and the viscosity (cP) of each lubricant. The viscosity of each lubricant was measured with a B viscometer, at a shear rate of 1.2/s and a temperature of 20° C. The lubricants were prepared by stirring the powder into water, separately adding the prescribed thickener and, if required, a surfactant. The resultant solution was then stirred into the water containing the powder, and, when necessary, caustic soda was added to obtain a lubricant with a pH of 7.

"Junron PW110" made by Nihon Junyaku Co. was used as the thickener listed in the table as a bridged compound type polyacrylic acid. "Reozic 306L" made by Nihon Junyaku Co. was used as the thickener listed in the table as a polysodium acrylate. "Metrose 4000" made by Shinetsu Chemical Co. was used as the thickener listed as a water soluble cellulose derivative. The amount of each thickener that was added to the lubricant solution was the amount required to achieve the listed apparent viscosity of the finished lubricant. Surfactants used were ethylene glycol fatty acid ester based or propylene fatty acid ester based, the former being used when "Junron PW110" was used as the thickener, and the latter being used when "Reozic 306L" was used as the thickener. The added amount of each surfactant is indicated as the concentration (in weight percent) of the surfactant in the lubricant.

The lubricants of Table 1 were used under the following conditions, with respect to the hot rolling of high chromium stainless steel. Slabs of ferritic stainless steel to be rolled each having a thickness of 200, a width of 1,030 to 1,240 mm and a weight of 10 to 14 tons were heated to 1,200° to 1,250° C., roughed to rough bars having a thickness of 25 mm, and hot rolled by means of a finish hot rolling mill comprising 7 stands to form hot-rolled coils having a thickness of 3.0 mm. The stainless steel contained, by weight, 0.01 to 0.06% C, 0.22 to 0.68% Si, 0.18 to 0.74% Mn, 17.9 to 22.1% Cr, 0.11 to 0.34% Ni, 0.03 to 2.0% Mo, 0 to 0.49% Nb, 0 to 0.58% Cu, 0.02 to 4.0% Al, 0 to 0.32% Ti, and 0.006 to 0.013% N. In accordance with the Cr amount expressed in equation (1), the stainless steels were ranked into three groups: those having a Cr content of approximately 20 to 23%, those having a Cr content of approximately 23 to 26%, and those having a Cr content of approximately 26 to 29%. The lubricants were used on 20 slabs in each Cr content group, so the lubricants were each applied to hot rolling of a total of 60 slabs.

Following replacement of the work rolls of the finish hot rolling mill by ground-finish rolls, the 20 slabs for each lubricant were continuously hot rolled; the type and amount of lubricant were fixed for the duration of each hot rolling cycle. The upper and lower work rolls of the first to third stands of the mill were selected as lubricant supply points, with each of the upper and lower rolls being provided with four nozzles, for a total of eight nozzles per stand. A plunger pump was used to pump the lubricant from these nozzles at a pressure of 40 kgf/cm$^2$. The amount of lubricant supplied to each roll was adjusted so that each roll received approximately 0.3 liter per square meter of roll surface. In the first to third stands of the finish hot rolling mill, high chromium rolls were used as the work rolls.

Water injection was used to supply the backup rolls with a conventional rolling lubricant oil. The hot rolled coils were each passed through a continuous annealing and pickling line, and after descaling the surface of each coil was examined and a count made of coils having surface defects caused by roll scoring. The results are shown in Table 2. With respect to each lubricant, the dispersion holding ability, dispersibility, sprayability and adhesive property were evaluated, as described below. Table 2 also includes the results of these evaluations.

The settling rate of the iron hydroxide powder was used to evaluate dispersion holding ability. The following equation was used to obtain the settling rate by allowing the lubricants to stand for one week, and then measuring the upper layer of the lubricant solution, that is, the separation volume.

Settling rate %=(separation volume after one week)÷(total volume)×100

In the four-category evaluation results shown in Table 3, ⊙ indicates a settling rate not exceeding 2%, ○ indicates a settling rate of 2 to 10%, Δ indicates a settling rate of 10 to 20%, and over 20% is indicated by X. Evaluation of dispersibility (the state of particle dispersion in a viscous aqueous solution) was made based on laser diffraction measurement of the maximum size (diameter) of dispersed particles. With reference to Table 3, ⊙ indicates a dispersed particle size of less than 40 μm, from 40 to 80 μm is indicated by ○, from 80 to 160 μm is indicated by Δ, and over 160 μm is indicated by X. Sprayability was judged by evaluating spray stability and spray width when the lubricant was sprayed from an oval spray nozzle measuring 0.5 by 1.0 mm at a pressure of 40 kg/cm$^2$. The results are shown in Table 3, using the same four-category system. Evaluation of the adhesive property was based on the thickness of the lubricant film formed on a roll, as measured by a laser-driven film thickness meter. The results are shown in Table 3.

The overall evaluation criteria column in Table 2 shows an overall evaluation of the suitability of lubricants as applied to high chromium stainless steel. The overall evaluation is a composite of laboratory evaluations of lubricant properties and the degree sticking (roll scoring) occurring under actual hot rolling conditions, with ○ indicating optimum suitability, Δ indicating insufficient effect, and X indicating no effect.

TABLE 1

| | Powder type & composition (wt %) | | | Median particle size | Powder content of lubricant | | Surfactant | | Lubricant viscosity | |
|---|---|---|---|---|---|---|---|---|---|---|
| No. | FeO(OH) | $Fe_2O_3$ | $Fe_3O_4$ | (μm) | (wt %) | Thickener | Y/N | Concentration (%) | (cP) | Notes |
| 1 | — | — | — | — | — | — | N | — | — | Comparative |
| 2 | — | — | 100 | 0.5 | 20 | — | N | — | 300 | Comparative |
| 3 | — | — | 100 | 0.5 | 20 | Bridged compound polyacrylic acid | N | — | 8800 | Comparative |
| 4 | — | — | 100 | 0.3 | 20 | Bridged compound polyacrylic acid | Y | 0.5 | 9600 | Comparative |
| 5 | 100 | — | — | 0.2 | 20 | Bridged compound polyacrylic acid | N | — | 12700 | Inventive |
| 6 | 100 | — | — | 0.2 | 20 | Water soluble cellulose derivative | N | — | 11200 | Comparative |
| 7 | 100 | — | — | 0.05 | 20 | Bridged compound polyacrylic acid | Y | 0.5 | 14300 | Comparative |
| 8 | 100 | — | — | 0.2 | 20 | Polysodium acrylate | Y | 0.6 | 800 | Comparative |

TABLE 1-continued

| No. | Powder type & composition (wt %) FeO(OH) | $Fe_2O_3$ | $Fe_3O_4$ | Median particle size (μm) | Powder content of lubricant (wt %) | Thickener | Surfactant Y/N | Surfactant Concentration (%) | Lubricant viscosity (cP) | Notes |
|---|---|---|---|---|---|---|---|---|---|---|
| 9 | 100 | — | — | 0.2 | 4 | Bridged compound polyacrylic acid | N | — | 5100 | Comparative |
| 10 | 100 | — | — | 0.2 | 10 | Bridged compound polyacrylic acid | Y | 1.0 | 13200 | Inventive |
| 11 | 100 | — | — | 0.2 | 20 | Bridged compound polyacrylic acid | N | — | 24800 | Inventive |
| 12 | 100 | — | — | 1.8 | 20 | Bridged compound polyacrylic acid | N | — | 22300 | Comparative |
| 13 | 100 | — | — | 0.2 | 10 | Bridged compound polyacrylic acid | N | — | 13900 | Inventive |
| 14 | 100 | — | — | 0.2 | 20 | Polysodium acrylate | Y | 6.2 | 6400 | Comparative |
| 15 | 100 | — | — | 0.2 | 20 | Bridged compound polyacrylic acid | Y | 3.6 | 24600 | Inventive |
| 16 | 90 | — | 10 | 0.3 | 20 | Polysodium acrylate | N | — | 4900 | Inventive |
| 17 | 90 | — | 10 | 0.3 | 50 | Bridged compound polyacrylic acid | N | — | 55900 | Comparative |
| 18 | 90 | 10 | — | 0.3 | 40 | Bridged compound polyacrylic acid | N | — | 44500 | Inventive |
| 19 | 100 | — | — | 0.2 | 40 | Bridged compound polyacrylic acid | N | — | 65500 | Comparative |

TABLE 2

| No. | Lubricant evaluation: Holding ability | Dispersibility | Sprayability | Adhesion | Number of coils with surface defects: Cr content 20–23% | Cr content 23–26% | Cr content 26–29% | Overall evaluation | Notes |
|---|---|---|---|---|---|---|---|---|---|
| 1 | — | — | — | — | 20 | Test halted | | X | Comparative |
| 2 | X | X | ◎ | X | 18 | 17 | Test halted | X | Comparative |
| 3 | ○ | Δ | ○ | X | 8 | 10 | Test halted | X | Comparative |
| 4 | Δ | ○ | ○ | ◎ | 0 | 3 | 3 | Δ | Comparative |
| 5 | ◎ | ◎ | ○ | ◎ | 0 | 0 | 0 | ○ | Inventive |
| 6 | X | ◎ | ○ | Δ | 12 | 15 | Test halted | X | Comparative |
| 7 | Δ | Δ | X | Δ | 13 | 10 | 13 | X | Comparative |
| 8 | Δ | Δ | ◎ | Δ | 7 | 7 | 8 | Δ | Comparative |
| 9 | ○ | Δ | ◎ | Δ | 6 | 4 | 6 | Δ | Comparative |
| 10 | ◎ | ◎ | ○ | ◎ | 0 | 0 | 0 | ○ | Inventive |
| 11 | ◎ | ◎ | ○ | ◎ | 0 | 0 | 0 | ○ | Inventive |
| 12 | ○ | X | Δ | Δ | 5 | 7 | 5 | X | Comparative |
| 13 | ◎ | ◎ | ○ | ◎ | 0 | 0 | 0 | ○ | Inventive |
| 14 | Δ | ○ | ◎ | ○ | 2 | 0 | 5 | Δ | Comparative |
| 15 | ◎ | ◎ | ○ | ◎ | 0 | 0 | 0 | ○ | Inventive |
| 16 | ◎ | ◎ | ◎ | ○ | 0 | 0 | 0 | ○ | Inventive |
| 17 | ○ | Δ | Δ | Δ | 7 | 4 | 6 | Δ | Comparative |
| 18 | ◎ | ○ | ○ | ◎ | 0 | 0 | 0 | ○ | Inventive |
| 19 | ◎ | Δ | Δ | ○ | 8 | 13 | 7 | Δ | Comparative |

TABLE 3

| Property | Lubricant property evaluation standards | ◎ | ○ | Δ | X |
|---|---|---|---|---|---|
| Holding ability | Settling | Not more than 2% | 2–10% | 10–20% | 20% or moe |
| Dispersibility | Particle size | <40 μm | 40–80 μm | 80–160 μm | >160 μm |
| Sprayability | Spray pressure | Stable 40 kg/cm$^2$ | Stable 40 kg/cm$^2$ | Unstable pressure | Nozzle clogging |
| | Spray width | 600 mm or more | 300–600 mm | 100–300 mm | Not more than 100 mm |
| Adhesion | Thickness of roll adhesion layer | 200 μm or more | 100–200 μm | 50–100 μm | Not more than 50 μm |

From the results shown in Table 2, it can be understood that when hot rolling of steel with a Cr content of up to 29% was carried out using lubricants Nos. 5, 10, 11, 13, 15, 16 and 18, the lubricants were effective in preventing roll scoring, there being no surface defects even after 20 coils were rolled after changing the rolling rolls, neither was there any clogging of nozzles. Moreover, the same effect was obtained with respect to coils that used these lubricants but had a chromium equivalent content lower than the listed levels, such as 16 to 18% or 18 to 20%.

In contrast, in the case of Comparative Example No. 1 that did not use lubricant, and Comparative Example No. 2 that just used iron oxide mixed with water, in the relatively low 20 to 23% Cr content category virtually all coils had defects. In the case also of lubricant No. 3 which contained added thickener but only iron oxide, a higher Cr content was accompanied by a higher defect rate. At the 26 to 29% Cr content level, all coils had surface defects. This means that the lubricant cannot be used with high chromium stainless steel. Lubricant No. 4, which differed from No. 3 by containing a surfactant, exhibited some roll scoring prevention effect, but not enough.

In the case of lubricant No. 6, which contained iron hydroxide but also contained a water soluble cellulose derivative thickener, all 20 of the coils in the 26 to 29% Cr content category had surface defects that would cause roll scoring. The reason for this might be the precipitation of the iron hydroxide powder owing to the poor holding ability of the lubricant (see Table 2).

An inspection of the nozzles after hot rolling using lubricant No. 7, which contains excessively free iron hydroxide powder, revealed that nozzles were clogged. This might be due in part to poor dispersion uniformity of the iron hydroxide. It is assumed that after about the thirteenth coil this resulted in an inadequate supply of lubricant during the hot rolling, as the following coils had surface defects. Almost no surface defect prevention effect was exhibited by lubricant No. 8, which contained iron hydroxide, a bridged compound type polyacrylic acid and a surfactant, but had a very low viscosity. A slight pickup prevention effect was observed with lubricant No. 9, which had a low iron hydroxide content, but it was not enough to adequately suppress defects.

Nozzles were found to be clogged after hot rolling using lubricant No. 12, which contained iron hydroxide powder having a very large particle size. Thus, although lubricant No. 12 had some contact prevention effect, it lacked practicality because it was difficult to provide the rolls with a stable supply of the lubricant. While lubricant No. 14, which contained an excessive amount of surfactant, did exhibit some effectiveness with respect to steel with a chromium content of 20 to 26%, it was not effective enough with respect to the 26 to 29% chromium content range. Lubricant No. 19 had an excessively high vicosity that produced spray instability, resulting in defects showing up starting from about the tenth coil, regardless of Cr content. The defects were probably caused by clogging of spray nozzles.

Example 2

Lubricants Nos. 21 to 26 listed in Table 4 were prepared. "Reozic 100" made by Nihon Junyaku Co. was used as the thickener described in Table 4 as xanthan gum. This is a xanthan gum heteropolysaccharide produced by carbohydrate fermentation with *Xanthomonas campestri*. The agarose polysaccharide used was agar, and the amirose polysaccharide used was starch. "Junron PW110" made by Nihon Junyaku Co. was used as the thickener described as a bridged compound type polyacrylic acid, and "Melrose 4000" made by Shinetsu Chemical Co. was used as the thickener described as a water soluble cellulose ether.

Each lubricant was left to stand for one week, and the upper layer of the lubricant solution, that is, the separation volume, was then measured to evaluate the dispersion holding ability into the four classes shown in Table 6. The results are listed in Table 5. An evaluation of the dispersibility (the state of particle dispersion in a viscous aqueous solution) in each lubricant was made, based on laser diffraction measurement of the maximum size (diameter) of dispersed particles. The four standards shown in Table 6 were used to make the evaluations; the results are listed in Table 5.

Because aggregation of the powder particles takes place if a lubricant happens to become diluted by water, clogging the spray nozzles, the aggregation property of diluted lubricants was examined. This was done by using an optical microscope to measure the size of particle aggregations resulting from water dilution of lubricants. The four standards shown in Table 6 were used to make the evaluations, and the results are listed in Table 5. Four percent by weight of water was used to dilute the lubricants. What is evaluated is the aggregation property when the aggregation is caused by a diluting admixture of water with lubricant in the supply pipes to the nozzles, during the standby period until the next rolling operation.

The lubricants were supplied to the rolls during the hot rolling of the stainless steel, by the same method used in example 1. However, in the first to third stands, high speed steel rolls were used as the rolls supplied with the lubricants. The stainless steel used contained, by weight, 0.01 to 0.06% C, 0.22 to 0.68% Si, 0.18 to 0.74% Mn, 17.9 to 22.1% Cr, 0.11 to 0.34% Ni, 0.03 to 2.0% Mo, 0 to 0.49% Nb, 0 to 0.58% Cu, 0.02 to 4.0% Al, 0 to 0.32% Ti, and 0.006 to 0.013% N. Slabs of this stainless steel were each heated to 1,200° to 1,250° C., roughed to rough bars having a thickness of 25 mm, and hot rolled by means of a finish hot rolling mill comprising 7 stands to form hot-rolled coils having a thickness of 3.0 mm.

After changing the work rolls of the finish hot rolling mill, for each lubricant 10 slabs were continuously hot rolled; the type and amount of lubricant were fixed for the duration of each hot rolling cycle. After this hot rolling, with the spraying equipment and reservoir tank remaining as they are, ten slabs were again rolled using the same conditions. The spray nozzles were checked for clogging, before and after these rolling operations. The lubricant spray point locations, supply method and supply rate were the same as those of example 1, and water injection was used to supply the backup rolls with a conventional rolling lubricant oil.

Clogging of spray nozzles and resistance to pickup were examined with respect to each lubricant. The results are included in Table 5. Nozzles were checked for clogging before and after each rolling pass. The presence or absence of pickup was determined by an evaluation of the roll skin after rolling, and an evaluation of the rolled steel surface after pickling. If after the rolling of ten coils for each lubricant there was clogging of spray nozzles or pickup in the case of even one coil, an X evaluation was used. An overall evaluation was given using the same criteria as example 1. The results are listed in Table 5.

TABLE 4

| | Powder type & composition (wt %) | | | | | Median particle size | Powder content of lubricant | | Thickener amount | Lubricant viscosity |
|---|---|---|---|---|---|---|---|---|---|---|
| No. | $Fe_2O_3$ | $Fe_3O_4$ | FeO(OH) | $SiO_2$ | $Al_2O_3$ | μm | (wt %) | Thickener | (wt %) | (cP) |
| 21 | | 400 | | | | 1.2 | 10 | Bridged compound polyacrylic acid | 0.25 | 6000 |
| 22 | 100 | — | — | — | — | 0.5 | 10 | Water soluble cellulose derivative | 2.0 | 5500 |

TABLE 4-continued

| No. | Powder type & composition (wt %) $Fe_2O_3$ | $Fe_3O_4$ | FeO(OH) | $SiO_2$ | $Al_2O_3$ | Median particle size μm | Powder content of lubricant (wt %) | Thickener | Thickener amount (wt %) | Lubricant viscosity (cP) |
|---|---|---|---|---|---|---|---|---|---|---|
| 23 | — | 100 | — | — | — | 0.2 | 20 | Xanthan gum | 0.25 | 4500 |
| 24 | — | — | 100 | — | — | 0.25 | 5 | Agarose polysaccharide/ agar | 3.0 | 5000 |
| 25 | — | 50 | — | 50 | — | 0.5 | 20 | Amirose polysaccharide/ starch | 2.0 | 9500 |
| 26 | — | — | 50 | 40 | 10 | 0.3 | 20 | Xanthan gum | 0.3 | 6700 |

TABLE 5

| No. | Lubicant property evaluation Holding ability | Dispersibility | Dilution based aggregation | Nozzle clogging during rolling Before rolling | After rolling | Roll scoring during hot rolling | Overall evaluation |
|---|---|---|---|---|---|---|---|
| 21 | Δ | Δ | X | Yes | Yes | Yes | X |
| 22 | X | X | X | Yes | Yes | Yes | X |
| 23 | ⊙ | ⊙ | ⊙ | No | No | No | ⊙ |
| 24 | ○ | Δ | Δ | No | Yes | Yes | X |
| 25 | ○ | Δ | Δ | No | Yes | Yes | X |
| 26 | ⊙ | ⊙ | ○ | No | No | No | ○ |

TABLE 6

| Property | Measurement item | Property evaluation standards ⊙ | ○ | Δ | X |
|---|---|---|---|---|---|
| Holding ability | Settling (After 1 week) | <2% | 2–10% | 10–20% | >20% |
| Dispersivity | Particle size (μm) (Max. particle size) | <40 μm | 40–80 μm | 80–160 μm | >160 μm |
| Dilution based aggregation | Aggregate particle size (mm) (4% dilution) | <0.2 mm | 0.2–0.5 mm | 0.5–1.0 mm | >1 mm |

The following can be understood from the results shown in Table 5. Lubricants Nos. 21 and 22 use iron oxide and a water soluble synthetic polymer as a thickener. The iron oxide in these lubricants tends to settle readily, and water dilution gives rise to large aggregate particles, the major cause of clogging of spray nozzles. As a result, nozzles did get clogged and roll scoring pickup could not be prevented. Lubricants Nos. 24 and 25, which used vegetable polysaccharides as thickeners, also gave rise to clogging of nozzles. Also, because of its low particle content, No. 24 exhibited no pickup prevention effect, while the dilution based large particle aggregation property of No. 25 resulted in pickup.

In contrast, lubricants Nos. 23 and 26, in which biogum was used as thickener, caused no clogging of nozzles and were able to suppress pickup. These lubricants can suppress dilution based aggregation and provide stable sprayability. They also exhibited no settling one week after being prepared, indicating good long-term holding stability and effective, consistent prevention of stainless steel sticking. No. 23, which used FeO(OH) powder, had particularly good resistance to nozzle clogging and roll scoring, showing no settling, a small dispersion particle size and a small dilution based aggregation particle size.

As described above, the lubricant according to the invention is effective in preventing roll scoring in hot rolling of high chromium stainless steel, and thereby enables high quality product to be obtained that is free of surface defects. In addition, damage to rolling rolls is reduced, thereby reducing roll trait requirements. Stainless steel sheet produced using the lubricant has such a beautiful surface that it does need to be ground, making it possible to produce, with good efficiency, high value added stainless steel sheet for use in mirror finished applications, for example.

What is claimed is:

1. A lubricant for use in hot rolling of high chromium stainless steel, the lubricant being continuously supplied to surfaces of hot rolling rolls in contact with the steel being rolled at least during hot rolling of the stainless steel, which lubricant comprises a viscous aqueous solution of water soluble high molecular weight thickener and from 10 to 40% by weight of iron hydroxide powder dispersed in the aqueous solution, said iron hydroxide powder being represented by the general formula FeO(OH) and having a median particle size of from not less than 0.1 μm to less than 1 μm and said lubricant having an apparent viscosity within the range of from 1,000 to 50,000 cP (centipoise).

2. The lubricant in accordance with claim 1 wherein the thickener is a water soluble bridged compound type polyacrylic acid.

3. The lubricant in accordance with scope of claim 1 wherein the thickener is a water soluble biopolymer.

4. The lubricant in accordance with claim 1 wherein the high chromium stainless steel has a chromium equivalent content of not less than 20% defined by $$\text{Cr equivalent content (\%)}=[Cr]+2[Si]+2.5[Al]+1.2[Mo]-30[C]-15[N]-2[Ni]-[Mn],$$

in which component elements in square brackets represent the content in weight percent of the component element in the steel.

5. The lubricant in accordance with scope of claim 1 further comprising a surfactant added in an amount not exceeding 5% by weight.

* * * * *